United States Patent [19]

Pfister et al.

[11] 4,050,888

[45] Sept. 27, 1977

[54] CONVEYOR SYSTEM FOR PASSING COATED CANS THROUGH CHAMBER

[75] Inventors: Lewis Pfister, White Plains; Edward Ehas, Floral Park, both of N.Y.

[73] Assignee: Flynn Burner Corporation, New York, N.Y.

[21] Appl. No.: 668,510

[22] Filed: Mar. 19, 1976

[51] Int. Cl.[2] ..... F27B 9/14; F26B 25/02

[52] U.S. Cl. ..... 432/124; 34/4; 34/105

[58] Field of Search ..... 432/124; 34/4, 105

[56] References Cited

U.S. PATENT DOCUMENTS

| | | | |
|---|---|---|---|
| 2,539,135 | 1/1951 | Hess | 432/124 |
| 3,840,999 | 10/1974 | Whelan | 34/105 |
| 3,917,445 | 11/1975 | Suva et al. | 432/124 |
| 3,935,647 | 2/1976 | Aschberger | 34/105 |

*Primary Examiner*—John J. Camby

[57] ABSTRACT

A conveyor system for conducting cans which are freshly coated with an ink or other coating through a chamber to dry or cure the coating, the chamber being provided with an energy-emitting source adapted to dry or cure the coating. In order to effect uniform exposure of the cans which are subjected to directed energy from the source, the system includes an endless link belt having a train of pins thereon which extend laterally into the chamber to support the cans, the belt being driven at a controllable speed to advance the cans through the chamber. Also included is an endless sprocket chain which cooperates with sprocket wheels mounted on the outer ends of the pins to cause the pins and the cans supported thereby to rotate as the cans advance through the chamber, the sprocket chain being driven in a selected direction and at a controllable speed relative to the speed of the belt, whereby the direction of can rotation and the rotary rate thereof are adjustable to optimize the drying or curing of the cans.

3 Claims, 5 Drawing Figures

32
26
24
C
31
21
fa
fb
22
23
30
A4
A3
A2
A1
29
25
28
15
P
11
13
14

CONVEYOR SYSTEM FOR PASSING COATED CANS THROUGH CHAMBER

BACKGROUND OF INVENTION

This invention relates generally to conveyors for advancing coated cans through drying or curing chambers, and more particularly to a conveyor system for concurrently rotating the advancing cans in a selected direction and at a controllable rate to ensure proper drying or curing of the cans.

Metal cans for beverages and food products are now mass-produced at exceptionally high rates. Many commercially-produced cans are fabricated by drawing and ironing a metal blank formed of aluminum or steel in a multi-phase operation, thereby avoiding the need for seaming. But before the cans are filled and a lid bonded thereto, it is customary to protectively coat and decorate the outer surface thereof. Such coatings are usually in three layers, the first being a base coat which is a uniform white or ground color. The second layer is the print coat in which printed and decorative matter is laid over the base coat. (In some instances, the print coat is applied directly to the metal can.) Finally, a third layer is applied, whose purpose is to protect the print layer, this overcoat being clear lacquer.

The coatings are generally of the lacquer type which dry or cure by evaporation of the volatile components. The film-forming constituent is usually a high molecular weight polymer, such as a polyester. Other types of lacquer coatings are based on acrylic resins. The solvents used are generally of the low-boiling type, such as aromatics.

It is essential, after each coating is laid down on the can surface, that it be dried to specifications. In some instances, the coatings must be thoroughly dried, in which event even the slightest tackiness is objectionable. In other cases, some residual wetness is acceptable. To this end, it has heretofore been the practice in order to achieve a high-production rate, to convey a continuous train of cans on a conveyor chain through an elongated oven in which the chain travels up and down through a sinuous path to lengthen the exposure time of the cans to the heat without unduly extending the length of the oven.

The heat supplied to such ovens is in indirect form in that air is first heated by a gas-flame burner external to the oven chamber and then blown into the oven at an elevated temperature sufficient to dry the fresh coatings on the cans passing therethrough but well below the ignition point of the coatings.

The existing indirect-heating technique for drying can coatings is inherently inefficient and wasteful in terms of energy expenditure. The heat to volatilize the solvents is derived from the heated atmosphere of the oven, whereas the heat to elevate the temperature of this atmosphere is derived from a gas-flame heater. Only a fraction of the thermal energy supplied by the gas-flame heater is exploited, for most of this energy is dissipated in heating a huge volume of air.

In the copending application of Edward S. Flynn, Ser. No. 630,350, filed Nov. 10, 1975, entitled "Direct Flame Apparatus for Drying Can Coatings," an apparatus is disclosed for drying a wet coating on the surface of cans, the apparatus including a conveyor for advancing the cans in a continuous train through a chamber having a series of direct-flame burner assemblies mounted thereon. Each can, in the course of its advance through the tunnel, is progressively heated by the assemblies to cause the cans to emerge from the chamber in a dried condition.

Inasmuch as the direct flame heater assemblies act to emit thermal energy mainly in one direction, in order to uniformly dry the cans, it is desirable to rotate the cans as they advance through the chamber so that all surfaces of the cans are exposed to the direct flame treatment.

The need to rotate cans as they advance through a treatment chamber also arises in other systems in which coated cans are subjected to other directed forms of energy. Thus in U.S. Pat. No. 3,840,999 of Whelan, there is disclosed apparatus for curing solvent-free inks and other solvent-free coatings, use being made for this purpose of an ultra-violet (UV) radiation-emitting curing lamp which emits UV energy principally in one direction.

In the conveyor disclosed in the Whelan patent, each can advancing through the chamber is supported on a mandrel carried by a motor-driven sprocket chain, the mandrel shaft having a pinion secured thereto which engages a fixed rack. As a consequence, the mandrel is caused to rotate as the can is advanced through the chamber, thereby exposing the entire surface of the can to UV radiation to effect curing of the can coating.

The drawback of this known arrangement is that rotation is necessarily in one direction and the rate of rotation is directly proportional to the speed of advance. Hence it is not possible to change the direction of can rotation or to vary the rate thereof independently of the conveyor speed so as to optimize the curing action.

While the present invention will be described in connection with a direct-flame drying technique as well as with a UV curing arrangement, it is to be understood that it is also applicable to any drying or curing arrangements using infra-red or other forms of directed energy which require can rotation in order to obtain a uniform drying or curing action.

It is also to be understood that the term "coating" as used herein is intended to encompass any lacquer, decorative layer, printing ink or other material applied to the surface of a can and that it includes solvent-free coatings as well as coatings incorporating volatile solvents.

SUMMARY OF INVENTION

In view of the foregoing, the main object of this invention is to provide a conveyor system for advancing coated cans through a drying or curing chamber and for rotating the advancing cans in a selected direction at a rate which is adjustable to optimize the curing or drying action.

More specifically, it is an object of this invention to provide a conveyor system constituted by a continuous belt and an independently movable continuous sprocket chain, the coated cans being supported by rotatable pins mounted on the belt, whereby movement of the belt causes the cans to advance through a treatment chamber, the pins having sprocket wheels engaging the sprocket chain where by movement of the chain at a speed different from that of the belt effects can rotation at a rate depending on this difference in a direction determined by the direction of chain movement.

A significant feature of a conveyor system according to the invention is that the operating parameters are fully controllable and can therefore be adjusted to effect drying or curing of various types of can coatings under conditions which are optimized for the particular coating.

Briefly stated, these objects are attained in a conveyor system having an endless link belt provided with a train of rotatable pins which extend laterally from the belt into a treatment chamber to support the coated cans, the belt being driven at a controllable speed in a direction advancing the cans through the chamber.

Also included in the system is an endless sprocket chain which cooperates with sprocket wheels mounted on the pins, the chain being driven at a controllable speed in a selected direction to cause the cans on the pins to rotate at a rate depending on the difference between the speeds of the belt and the chain in a direction determined by the selected chain direction.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

The Conveyor System for a Direct-Flame Drying Apparatus

Figure 1:
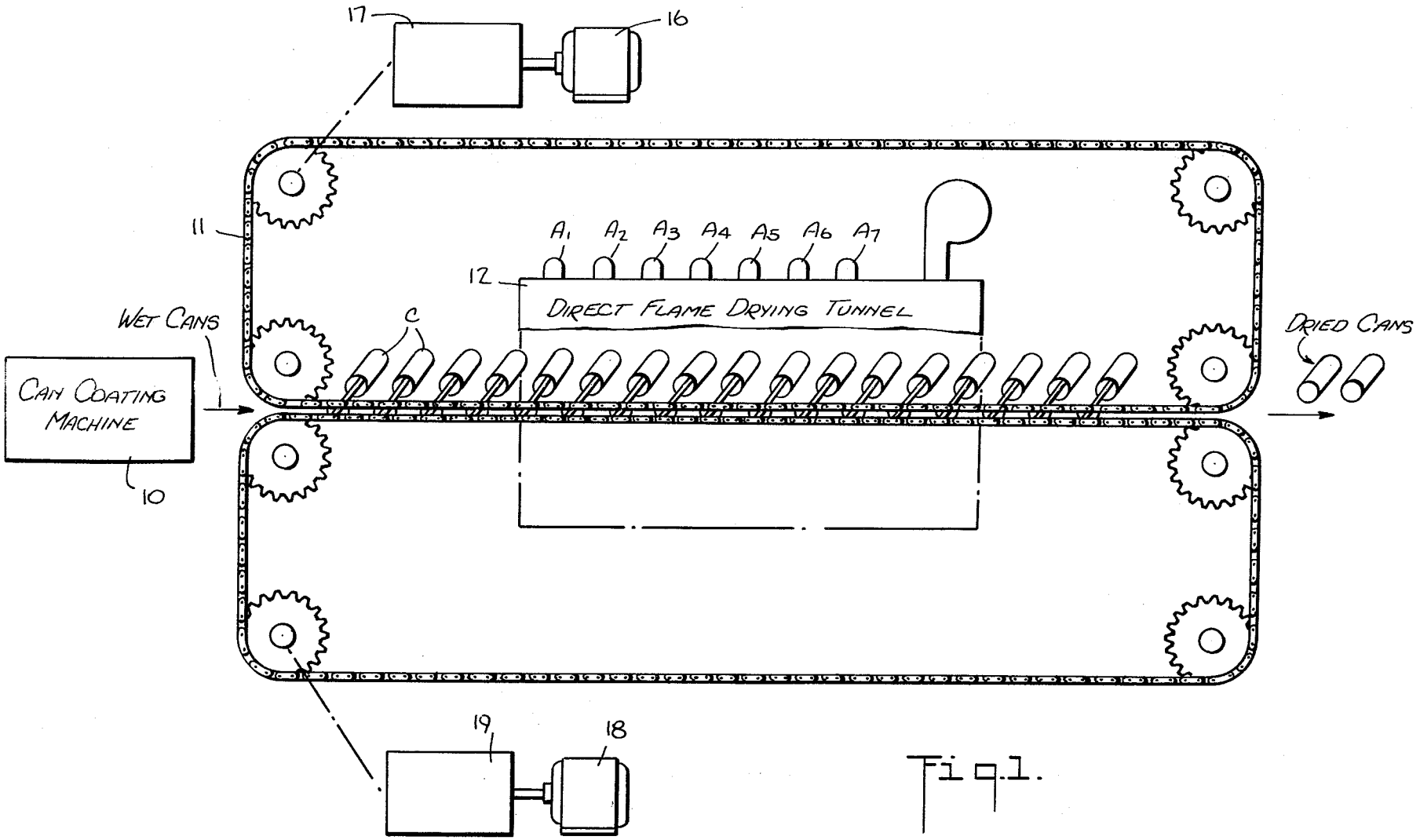
FIG. 1 is a block diagram of a can conveyor system in accordance with one embodiment of the invention, the system operating in conjunction with a direct-flame drying apparatus.
Figures 2, 3, 4, 5:
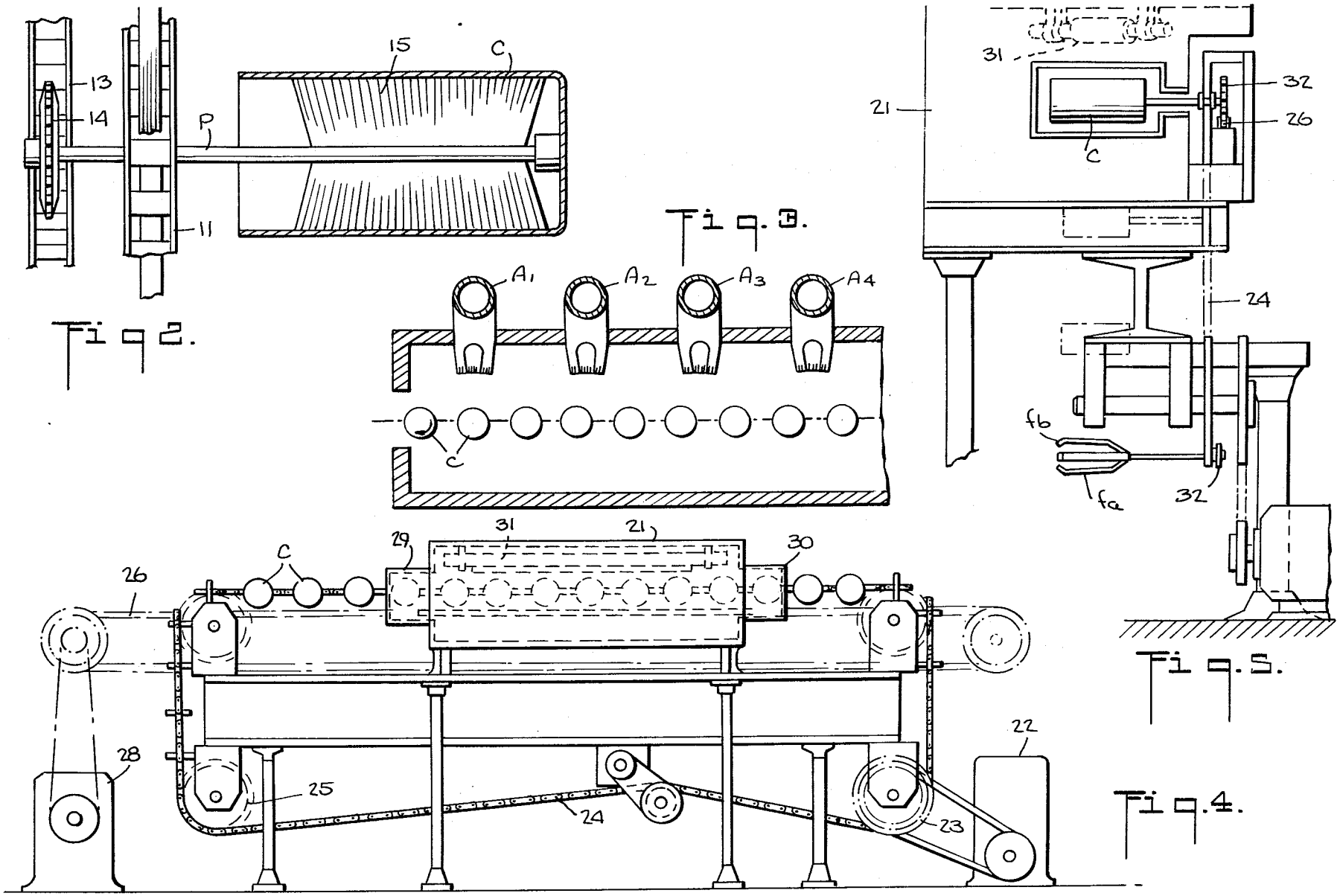
FIG. 2 illustrates, in plan view, the manner in which one can is carried by the conveyor system.
FIG. 3 is a longitudinal section taken through a portion of the tunnel included in the drying apparatus.
FIG. 4 is an elevation view of an ultra-violet curing apparatus which includes a can conveyor system in accordance with another embodiment of the invention.
FIG. 5 is a side view of the conveyor system shown in FIG. 4.

Referring now to FIGS. 1 to 3, there is shown a conveyor system in accordance with the invention adapted to dry coatings applied to the cylindrical surface of freshly-coated cans C emerging from a coating machine 10. The nature of this coating machine forms no part of the present invention.

Cans C from the coating machine are fed by a suitable transfer mechanism onto pins P mounted for rotation at equispaced points along an endless link belt 11 which functions to advance the cans in a continuous train through a direct-flame drying tunnel 12. As the cans travel on belt 11, they are caused simultaneously to rotate by means of an endless sprocket chain 13 which is engaged by sprocket wheels 14 attached to the ends of the pins.

The means by which cans C are rotated as they are advanced is separately illustrated in FIG. 2, where it will be seen that each rotatable pin P carried by chain belt 11 and extending laterally from both sides thereof supports a can C on one end, the other end of the pin having a sprocket wheel 14 keyed thereon.

Sprocket wheel 14 engages sprocket chain 13 and is turned thereby. The can-supporting end of pin P is provided with flexible bristles to form a brush 15 which resiliently engages the inner surface of the can and serves to hold the can concentrically with respect to the pin. The mounting of the cans on the conveyor pins and the withdrawal of the cans therefrom may be effected by a transfer mechanism having a vacuum chuck adapted to engage the bottom wall of the cans.

Rotation of pins P while the cans are being advanced on chain belt 11 and the rate and direction of such rotation depends on differential movement of belt 11 and sprocket chain 13. When both the belt and chain travel in the same direction and at exactly the same speed, sprocket wheel 14 is inactive, but when a difference therebetween in speed or in direction takes place, then wheel 14 is caused to rotate clockwise or counterclockwise at a rate which is a function of this difference.

In order to adjust the speed at which the train of cans C is advanced through the tunnel, link belt 11 is driven by a motor 16 through a variable-speed gear train 17 or other speed control means. And in order to adjust the direction and rate of rotation of pins P, sprocket chain 13 is driven by a motor 18 through a variable speed gear train 19. Thus the operating parameters of the conveyor system are adjustable to satisfy particular can drying requirements.

A drying tunnel 12 is provided in the form of a thermally-insulated elongated enclosure having a rectangular cross-section. The pin-borne cans C rotating on conveyor chain 11 enter the tunnel through an inlet and the cans exit therefrom through an outlet. The drying tunnel is provided with a longitudinal slot through which chain belt 11 passes, so that the cans move within the tunnel, whereas sprocket wheel 14 and sprocket chain 13 associated therewith for controlling can rotation lie outside the tunnel.

Mounted in a row on the top wall of tunnel 12 is a series of equi-spaced, gas-fired direct flame assemblies generally designated by letters $A_1$, $A_2$, $A_3$, $A_4$, $A_5$, $A_6$, $A_7$ and $A_8$, which function to progressively dry the can coatings. In practice, a greater or smaller number of flame assemblies may be used to satisfy the drying requirements. Also instead of mounting all burners above the advancing cans, they may be arranged alternately on the top and bottom walls so that one burner in the series produces a downwardly projecting flame, the next an upwardly projecting flame and so on.

Each assembly is arranged to emit a downwardly-directed sheet of flame which impinges on the rotating can passing therebelow, the sheet of flame being flanked by air curtains serving to confine the applied heat to a limited sector of the can and to supply additional air to the heating zone to promote combustion. Thus while the flame is directional, as the can rotates, its coating is fully exposed to the flame. A more detailed description of the tunnel and the burner assemblies and the manner in which drying is effected is set forth in the above-identified copending Flynn application.

Conveyor System for Ultraviolet Curing Apparatus:

Referring now to FIGS. 4 and 5, there is shown an apparatus for curing the coating of cans C by means of ultra-violet radiation. These coatings are constituted by a solvent-free ink or other coating material which is curable by ultra-violet energy, the coating material and the ultraviolet curing source being more fully disclosed in U.S. Pat. No. 3,840,999, whose disclosure is incorporated herein by reference. Thus in this embodiment, ultraviolet energy is used rather than thermal energy.

The conveyor system for advancing cans C through an oven 21 includes a variable speed motor 22 which is coupled by a sprocket chain to a main drive gear 23, gear 23 operating an endless link belt 24. Belt 24 is looped around rotating idler, including idler 25, which define the path followed by the belt.

Coated cans C are transferred from a coating machine to pins P mounted for rotation on link belt 24 and are advanced thereby through oven 21. In lieu of a brush, as in the previous embodiment, the cans are securely and concentrically held on the pins by means of an array of resilient fingers $f_a$, $f_b$, etc. The fingers are outwardly biased to engage the inner wall of the can so that rotation of the pin results in rotation of the can supported thereon.

Pins P are provided at their ends with sprocket wheels 32 which engage an endless sprocket chain 26 operated by a drive wheel 27. Chain 26 is driven in a selected direction at a desired speed by a variable speed motor 28. Thus as the cans are advanced through the oven, the pins are rotated at a rate which depends on the relative speed of the belt and sprocket chain in a direction determined by the direction of chain movement.

Curing oven 21 is provided with an inlet 29 and an outlet 30 which are relatively narrow to minimize the escape of ultraviolet radiation from the oven. Mounted within the oven is an ultraviolet radiation-emitting lamp 31 having reflector means to focus radiation on the cans passing therebelow. The lamp is oriented to uniformly and efficiently distribute radiation over the entire periphery of the coated cans as they rotate while being advanced through the oven. In practice, a plurality of such lamps may be used rather than a single lamp. The radiation from the lamp is highly directional, hence rotation of the cans is essential in order to effect uniform exposure and curing of the entire coating thereon.

While there has been shown and described preferred embodiments of a conveyor system for passing coated cans through a chamber in accordance with the invention, it will be appreciated that many changes and modifications may be made therein without, however, departing from the essential spirit thereof. Thus the conveyor may be used to advance and concurrently rotate objects other than cans, and for this purpose the pins are provided with appropriate means to secure the objects to the pins. Also, while the embodiments disclosed herein show exposure of cans to a direct flame or ultraviolet radiation, other energy forms may be used for treatment of cans or other articles.

We claim:

1. A conveyor system for conducting objects which are cans having a fresh coating thereon through a chamber for treating said can coatings and for concurrently rotating these objects to optimize said treatment, said system comprising:

A. an endless belt for conducting said objects through said chamber and having rotatable pins mounted thereon, the pins extending laterally from the belt, one end of the pins having means thereon for supporting said objects, the other end of each pin having a sprocket wheel secured thereto;

B. an endless sprocket chain disposed in parallel relation to said belt, said chain being engaged by the sprocket wheels mounted on said pins;

C. first variable speed drive means operatively coupled to said belt to cause movement thereof in a predetermined direction to advance said objects through said chamber at a desired speed; and D. second variable speed drive means independent of said first means and operatively coupled to said chain to cause movement thereof in a selectable direction to cause the pin-borne objects to rotate at a rate determined by the relative speeds of said belt and said chain and in a direction determined by the selected direction.

2. A system as set forth in claim 1, wherein fresh coatings are heat dryable and said chamber is provided with burners to dry said coatings.

3. A system as set forth in claim 1, wherein said fresh coatings are curable by ultra-violet radiation and said chamber is provided with an ultra-violet lamp whose rays are directed onto the can to cure said coatings.

* * * * *